US010369674B2

(12) United States Patent
Cezario et al.

(10) Patent No.: US 10,369,674 B2
(45) Date of Patent: Aug. 6, 2019

(54) VIBRATORY TREATMENT APPARATUS

(71) Applicants: ROLLS-ROYCE plc, London (GB); ROLLS-ROYCE DEUTSCHLAND LTD & CO KG, Blankenfelde-Mahlow, Dahlewitz (DE); ROLLS-ROYCE MARINE AS, Ulsteinvik (NO)

(72) Inventors: João Paulo Siqueira Cezario, Brattvaag (NO); Chow Cher Wong, Singapore (SG); Dennis Tan Cheng Cheh, Singapore (SG); Wei Chuen Wallace Ong, Singapore (SG); Goetz G Feldmann, Oberursel (DE); Ampara Aramcharoen, Bangkok (TH); Kok Li Tan, Singapore (SG); Chao Yen Liew, Singapore (SG)

(73) Assignees: ROLLS-ROYCE plc, London (GB); ROLLS-ROYCE DEUTSCHLAND LTD & CO KG, Dahlewitz (DE); ROLLS-ROYCE MARINE AS, Ulsteinvik (NO)

( * ) Notice: Subject to any disclaimer, the term of this patent is extended or adjusted under 35 U.S.C. 154(b) by 142 days.

(21) Appl. No.: 15/602,550

(22) Filed: May 23, 2017

(65) Prior Publication Data

US 2017/0348818 A1 Dec. 7, 2017

(30) Foreign Application Priority Data

Jun. 2, 2016 (GB) ..... 1609619.0

(51) Int. Cl.
*B24B 31/00* (2006.01)
*B24B 19/14* (2006.01)
(Continued)

(52) U.S. Cl.
CPC ..... *B24B 31/003* (2013.01); *B24B 19/14* (2013.01); *B24B 31/062* (2013.01); *B24B 31/064* (2013.01); *B24B 57/02* (2013.01)

(58) Field of Classification Search
CPC ..... B24B 31/003; B24B 19/14; B24B 31/062; B24B 31/064; B24B 57/02; B24B 31/006; B24B 31/014; B24B 31/00
(Continued)

(56) References Cited

U.S. PATENT DOCUMENTS 3,163,966 A * 1/1965 Moore ..... B06B 3/00 451/326
3,300,908 A * 1/1967 Rampe ..... B24B 31/06 366/108

(Continued)

FOREIGN PATENT DOCUMENTS

DE 2364265 A1 7/1975
EP 1177857 A2 2/2002

OTHER PUBLICATIONS

Nov. 2, 2016 Search Report issued in British Patent Application No. 1609619.0.

(Continued)

*Primary Examiner* — Robert A Rose
(74) *Attorney, Agent, or Firm* — Oliff PLC

(57) ABSTRACT

Vibratory treatment apparatus including a first receptacle arranged to receive media for vibratory treatment of the article, the first receptacle defining a first aperture; and a first valve positioned at the first aperture of the first receptacle, the first valve being arranged to allow passage of the article there through and to prevent the flow of media through the first aperture.

14 Claims, 5 Drawing Sheets

(51) Int. Cl.
*B24B 57/02* (2006.01)
*B24B 31/06* (2006.01)

(58) Field of Classification Search
USPC ..... 451/36, 113, 104
See application file for complete search history.

(56) References Cited

U.S. PATENT DOCUMENTS 3,371,449 A * 3/1968 Olson ..... B24B 31/064 451/32
3,382,844 A * 5/1968 Kumpf ..... B65G 49/0463 118/418
3,546,821 A * 12/1970 Strom ..... B24B 31/06 241/46.04
3,570,183 A * 3/1971 Ferrara ..... B24B 31/02 451/113
3,948,002 A * 4/1976 Kobayashi ..... B24B 31/073 451/326
4,091,575 A * 5/1978 Rampe ..... B24B 31/06 451/327
4,173,851 A * 11/1979 Higashi ..... B24B 31/003 451/113
4,240,229 A * 12/1980 Ohno ..... B24B 31/003 451/106
4,301,625 A * 11/1981 Rampe ..... B24B 31/073 451/327
4,581,853 A * 4/1986 Marcus ..... B24B 31/003 451/104
4,730,417 A * 3/1988 Davidson ..... B24B 31/104 451/106
4,823,513 A * 4/1989 Marcus ..... B24B 31/064 134/1
4,917,708 A * 4/1990 Yamaguchi ..... B23Q 7/02 451/102
4,991,360 A * 2/1991 DeSpain ..... B24B 31/003 451/104
5,090,870 A * 2/1992 Gilliam ..... B24B 31/033 29/402.04
5,251,409 A * 10/1993 Orbank ..... B24B 31/003 451/113
5,276,998 A * 1/1994 Joen ..... B24B 31/064 451/104
5,653,247 A * 8/1997 Murakami ..... B08B 3/02 134/102.3
6,210,258 B1 * 4/2001 Malkin ..... B24B 31/073 451/32
6,406,356 B1 * 6/2002 Brooks ..... B24B 31/003 451/104
6,572,458 B2 * 6/2003 Lim ..... B24B 31/003 451/106
6,960,116 B2 * 11/2005 McNeil ..... B24B 31/003 451/104
6,962,522 B1 * 11/2005 Kawasaki ..... B24B 31/003 451/104
8,662,960 B2 * 3/2014 Inatani ..... B24B 31/064 451/34
8,920,215 B2 * 12/2014 Redaelli ..... B24B 31/003 451/106
9,550,272 B2 * 1/2017 Sroka ..... B24B 31/003
2002/0077047 A1 * 6/2002 Kawasaki ..... B24B 1/00 451/326
2002/0115393 A1 * 8/2002 Fujishiro ..... B24B 31/033 451/328
2006/0140732 A1 * 6/2006 Hecht ..... B23B 27/141 408/199
2006/0246825 A1 * 11/2006 Bolz ..... B24B 31/0224 451/36
2012/0266426 A1 * 10/2012 Feldmann ..... B24B 31/003 29/90.01
2012/0309279 A1 * 12/2012 Okoshi ..... B24B 9/007 451/541
2013/0000683 A1 * 1/2013 Alvarez ..... B08B 3/02 134/34
2015/0099429 A1 * 4/2015 Ekanayake ..... B24C 3/32 451/36

OTHER PUBLICATIONS

Jul. 20, 2017 Search Report issued in European Patent Application No. 17172203.6.

* cited by examiner

VIBRATORY TREATMENT APPARATUS

TECHNOLOGICAL FIELD

The present disclosure concerns vibratory treatment apparatus.

BACKGROUND

Vibratory treatment apparatus usually includes: a receptacle filled with media; and an actuator for vibrating the receptacle and thereby moving the media within the receptacle. For example, vibratory treatment apparatus may include a bowl vibrator or a trough vibrator having a vibration generator (such as one or more motors located at the bottom or side of the receptacle for driving rotating shafts with eccentric weights).

In operation, an article to be treated (such as a fan blade of a gas turbine engine) is placed within the receptacle so that it is immersed within the media. The receptacle is then vibrated by the actuator so that the media moves within the receptacle and rubs against the article and thereby performs surface treatment on the article.

BRIEF SUMMARY

According to various examples there is provided vibratory treatment apparatus comprising: a first receptacle arranged to receive media for vibratory treatment of an article, the first receptacle defining a first aperture; and a first valve positioned at the first aperture of the first receptacle, the first valve being arranged to allow passage of the article there through and to prevent the flow of media through the first aperture.

The vibratory treatment apparatus may further comprise a second receptacle arranged to receive the first receptacle therein. The first receptacle may have a first depth and the second receptacle may have a second depth. The first depth may be less than the second depth.

The first receptacle may be coupled to the second receptacle via one or more fasteners.

A width of the first receptacle may be less than a width of the second receptacle.

A length of the first receptacle may be less than a length of the second receptacle.

The vibratory treatment apparatus may further comprise a fixture arranged to support an article for receiving vibratory treatment; and a first actuator arranged to move the fixture relative to the first receptacle.

The fixture may be arranged to support a plurality of articles for receiving vibratory treatment.

The vibratory treatment apparatus may further comprise a second actuator arranged to move the first receptacle to vibrate the media relative to the first receptacle.

The first receptacle may define a second aperture. The vibratory treatment apparatus may further comprise a second valve positioned at the second aperture of the first receptacle. The second valve may be arranged to allow passage of another article there through and to prevent flow of the media through the second aperture.

The media may be vibratory polishing media.

The media may be vibratory peening media.

The article may be a fan blade of a gas turbine engine.

According to various examples there is provided a method of vibratory treating an article, the method comprising: providing vibratory treatment apparatus as claimed in any of the preceding claims; and controlling movement of the article relative to the first receptacle and through the first aperture of the first receptacle.

The method may further comprise controlling a second actuator to move the first receptacle to vibrate the media relative to the first receptacle.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DESCRIPTION

Embodiments will now be described by way of example only, with reference to the Figures, in which.

DETAILED DESCRIPTION

In the following description, the terms 'connected' and 'coupled' mean operationally connected and coupled. It should be appreciated that there may be any number of intervening components between the mentioned features, including no intervening components.

Figure 1:
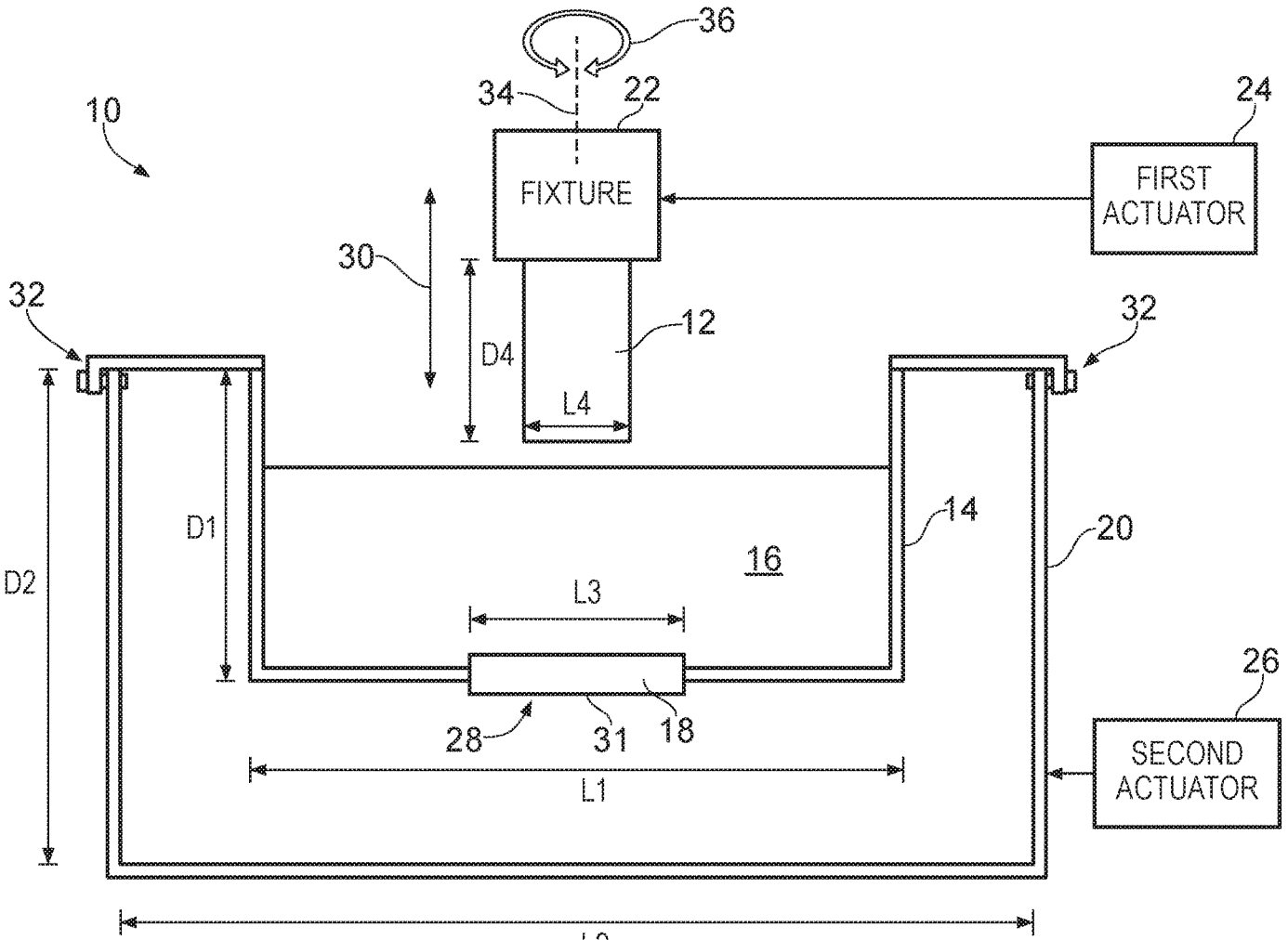
FIG. 1 illustrates a schematic cross sectional side view of vibratory treatment apparatus according to various examples.

FIG. 1 illustrates vibratory treatment apparatus 10 for vibratory treating an article 12. The vibratory treatment apparatus 10 includes a first receptacle 14, media 16, a valve 18, a second receptacle 20, a fixture 22, a first actuator 24, and a second actuator 26. In some examples, the vibratory treatment apparatus 10 may be a module. As used herein, the wording 'module' refers to a device or apparatus where one or more features are included at a later time and, possibly, by another manufacturer or by an end user. For example, where the vibratory treatment apparatus 10 is a module, the vibratory treatment apparatus 10 may only include the first receptacle 14 and the valve 18, and the remaining features (in particular, the media 16, the second receptacle 20, the fixture 22, the first actuator 24 and the second actuator 26) may be added by another manufacturer, or by the end user.

The first receptacle 14 may have any suitable shape and may be trough shaped or bowl shaped for example. The first receptacle 14 defines a cavity having an opening for receiving media 16 therein. The first receptacle 14 also defines an aperture 28 opposite the opening of the cavity. The first receptacle 14 has a depth D1, a length L1, and a width W1 (illustrated in FIG. 2).

The aperture 28 of the first receptacle 14 is sized and shaped to allow the article 12 to move there through. For example, the aperture 28 may have a slot shape that extends for at least a portion of the length L1 of the first receptacle 14.

The media 16 may be any suitable media for vibratory treatment of the article 12. For example, the media 16 may be vibratory peening media that comprises a plurality of metallic spheres (steel spheres for example). By way of another example, the media 16 may be vibratory polishing media that comprises a plurality of ceramic spheres.

The valve 18 is positioned at the aperture 28 of the first receptacle 14. For example, the valve 18 may be positioned within the aperture 28. Alternatively, the valve 18 may cover the aperture 28, but may not be positioned within the aperture 28. The valve 18 is sized and shaped to block the aperture 28.

The valve 18 may be reconfigured between a first configuration and a second configuration. In the first configuration, the valve 18 is closed and prevents the media 16 from flowing through the aperture 28 (in other words, the valve 18 blocks the aperture 28). In the second configuration, the valve 18 is open and allows passage of the article 12 there through, but prevents the flow of media 16 through the first aperture 28. In various examples, the valve 18 may comprise an elastic material (such as rubber) that defines an aperture 31 (having a length L3) which is closed when the valve 18 is in the first configuration, and is open when the valve 18 is in the second configuration. The opening 31 of the valve 18 snugly fits around the article 12 when in the second configuration and thus prevents media 16 from flowing through the gap between the article 12 and the valve 18, while the article 12 is moving through the opening 31.

Figure 2:
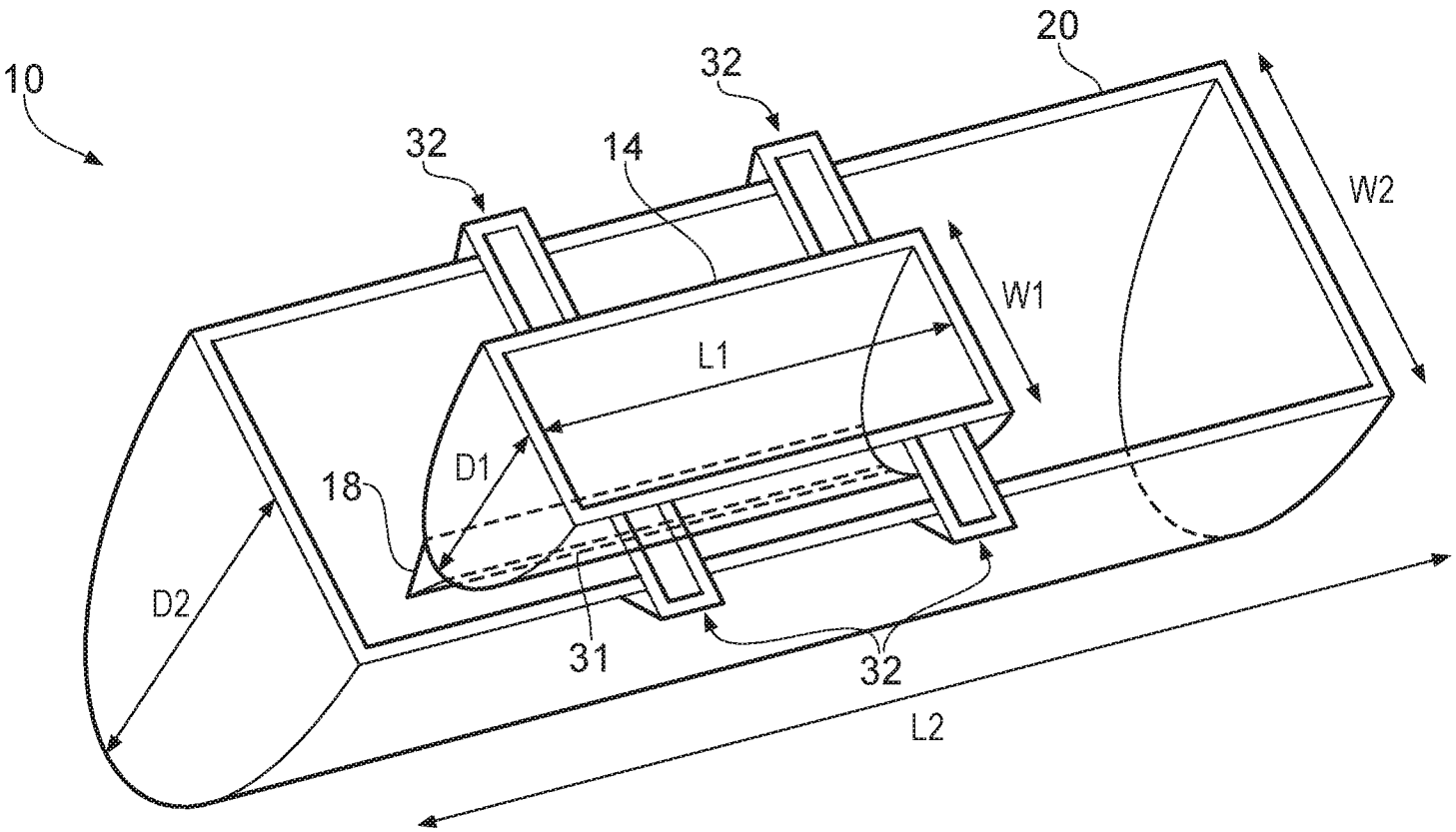
FIG. 2 illustrates a perspective view of the vibratory treatment apparatus illustrated in FIG. 1.

The valve 18 may be a two way valve (that is, allowing passage of the article 12 through the first aperture 28 in both an upward and a downward direction as indicated by arrow 30 in FIG. 1) or may be a one way valve (that is, allowing passage of the article 12 through the first aperture 28 in either an upward direction or a downward direction). For example, FIG. 2 illustrates a vibratory treatment apparatus 10 including a one way valve that is arranged to allow the article 12 to move downwards through the aperture 28.

The second receptacle 20 may have any suitable shape and may be trough shaped or bowl shaped for example. The second receptacle 20 defines a cavity having an opening for receiving the first receptacle 14 therein. The second receptacle 20 has a depth D2, a length L2, and a width W2 (illustrated in FIG. 2). The depth D1 of the first receptacle 14 is less than the depth D2 of the second receptacle 20 and consequently, the cavity of the first receptacle 14 has a smaller volume than the cavity of the second receptacle 20. The length L1 of the first receptacle 14 may be less than the length L2 of the second receptacle 20. Additionally or alternatively, the width W1 of the first receptacle 14 may be less than the width W2 of the second receptacle 20.

The first receptacle 14 may be coupled to the second receptacle 20 and together, the first receptacle 14 and the second receptacle 20 may form a rigid structure. In various examples, the first receptacle 14 may be coupled to the second receptacle 20 via one or more fasteners 32 (such as one or more nut and bolt arrangements as illustrated in FIG. 1). In other examples, the first receptacle 14 and the second receptacle 20 may be welded to one another.

The fixture 22 is arranged to support the article 12 and may comprise one or more fasteners (for example, one or more clamps) for holding the article 12. The first actuator 24 is arranged to move the fixture 22 (and consequently, the article 12) relative to the first receptacle 14 in the directions of arrow 30. The first actuator 24 may also be arranged to rotate the fixture 22 (and thus the article 12) about a vertical axis 34 (which is parallel to the arrow 30) in the directions of arrow 36. The first actuator 24 may include any suitable device or devices for moving the fixture 22, and may include one or more servomotors.

The second actuator 26 is arranged to move the first receptacle 14 to vibrate the media 16 relative to the first receptacle 14. For example, the second actuator 26 may include one or more motors located at the bottom or side of the second receptacle 20 for driving rotating shafts with eccentric weights for moving the second receptacle 20 and consequently, the first receptacle 14.

The article 12 may be any object, product, component, or assembly of components for receiving vibratory treatment. For example, the article 12 may be an aerospace component (such as a fan blade of a gas turbine engine), or an assembly of aerospace components. The article 12 has a depth D4, a length L4 and a width (not illustrated in FIG. 1). The depth D4 of the article 12 may be greater than the depth D1 of the first receptacle 14. The length L3 of the opening 31 of the valve 18 is greater than the length L4 of the article 12 and consequently, the article 12 may move through the opening 31 of the valve 18. The depth of the gap between the first receptacle 14 and the second receptacle 20 (equal to D2-D1) may be greater than the depth D4 of the article 12.

Figure 3:
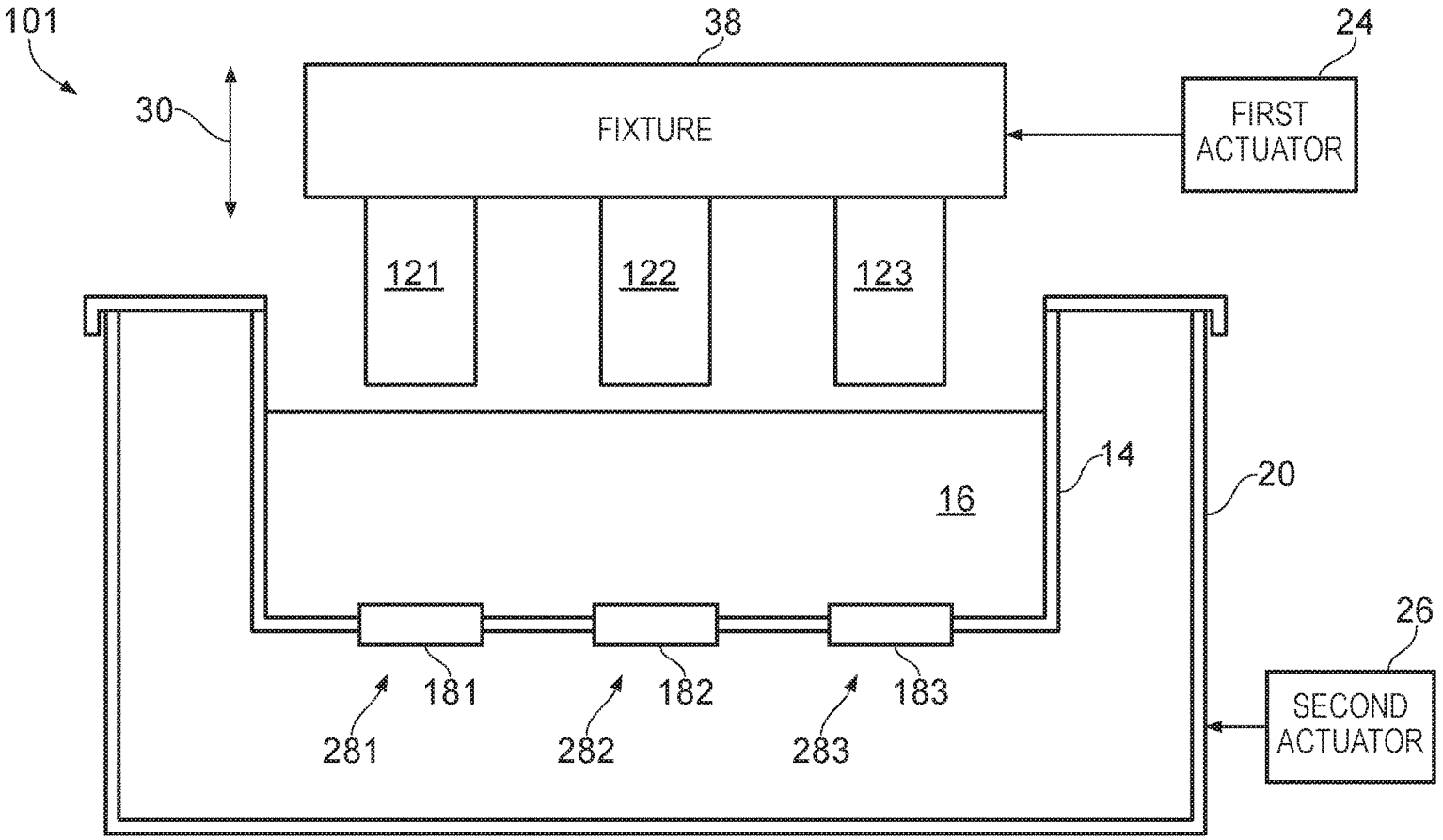
FIG. 3 illustrates a schematic cross sectional side view of another vibratory treatment apparatus according to various examples.

FIG. 3 illustrates a schematic cross sectional side view of another vibratory treatment apparatus 101 according to various examples. The vibratory treatment apparatus 101 is similar to the vibratory treatment apparatus 10 illustrated in FIGS. 1 and 2 and where the features are similar, the same reference numerals are used.

The vibratory treatment apparatus 101 differs from the vibratory treatment apparatus 10 in that the vibratory treatment apparatus 101 includes a plurality of valves positioned at a plurality of apertures defined within the first receptacle 14. In the example illustrated in FIG. 3, the vibratory treatment apparatus 101 includes a first valve 181, a second valve 182 and a third valve 183 that are positioned at a first aperture 281, a second aperture 282 and a third aperture 283 defined by the first receptacle 14 respectively. It should be appreciated that in other examples, the vibratory treatment apparatus 101 may have a different number of valves, and may have one or more valves for allowing the passage of a plurality of articles there through.

The vibratory treatment apparatus 101 also differs from the vibratory treatment apparatus 10 in that the vibratory treatment apparatus 101 comprises a fixture 38 that is arranged to support a plurality of articles. In the example illustrated in FIG. 3, the fixture 38 is arranged to support a first article 121, a second article 122, and a third article 123. It should be appreciated that in other examples, the fixture 38 may be arranged to support a different number of articles, and may be arranged to support two or more articles. Furthermore, it should be appreciated that the articles supported by the fixture 38 may be the same (for example, the fixture 38 may be arranged to support a plurality of fan blades), or may be different to one another. The fixture 38 may be arranged so that each of the articles 121, 122, 123 may be rotated independently of one another.

Figure 4:
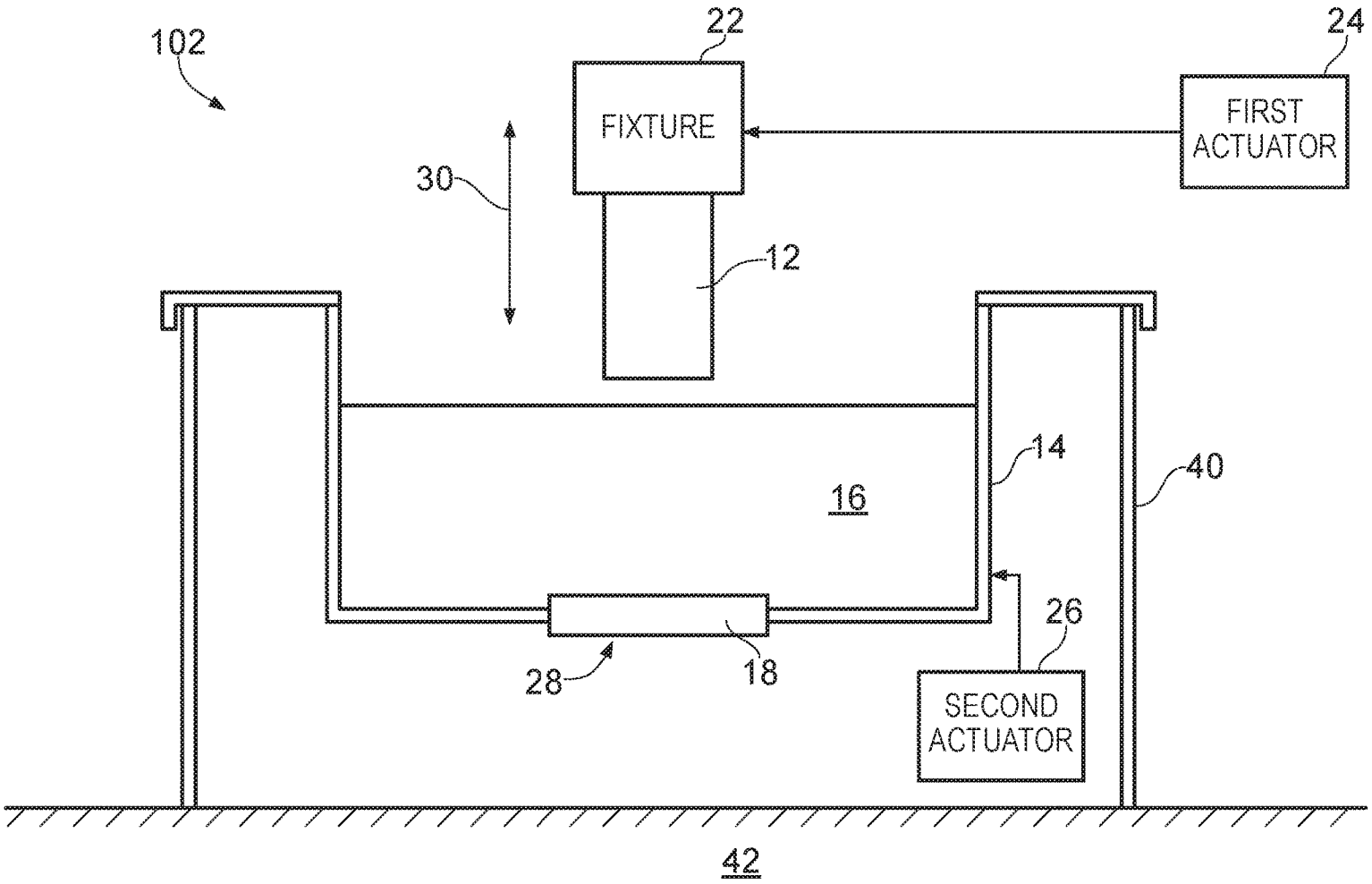
FIG. 4 illustrates a schematic cross sectional side view of a further vibratory treatment apparatus according to various examples.

FIG. 4 illustrates a cross sectional side view diagram of a further vibratory treatment apparatus 102 according to various examples. The vibratory treatment apparatus 102 is similar to the vibratory treatment apparatus 10 and where the features are similar, the same reference numerals are used.

The vibratory treatment apparatus 102 differs from the vibratory treatment apparatus 10 in that the vibratory treatment apparatus 102 does not include a second receptacle 20. Instead, the vibratory treatment apparatus 102 includes a support 40 for holding the first receptacle 14 above the ground 42. The support 40 may have any suitable structure and may comprise any suitable materials. For example, the support 40 may comprise a metal cylinder and the first receptacle 14 may be coupled to the top end of the cylinder. The second actuator 26 is arranged to move the first receptacle 14 to vibrate the media 16 within the first receptacle 14.

Figure 5:
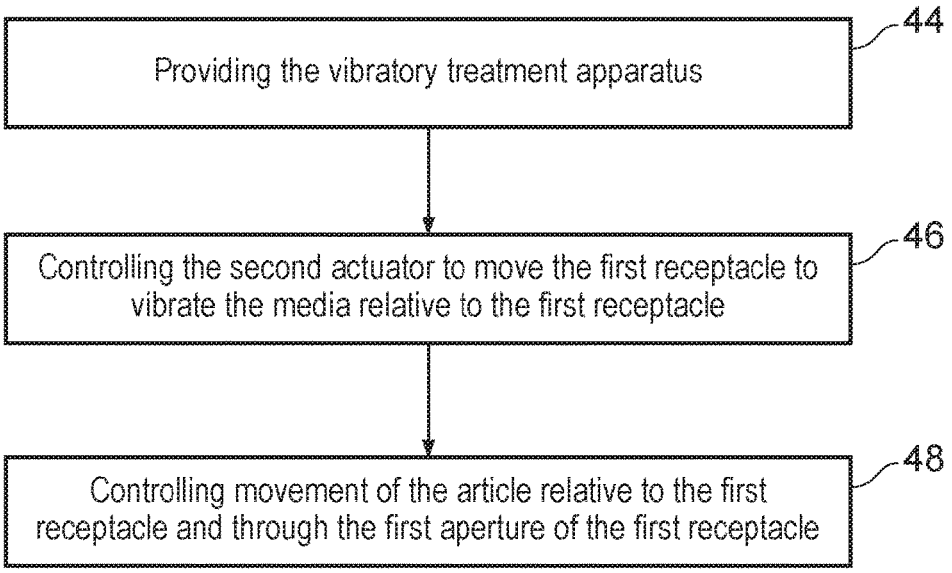
FIG. 5 illustrates a flow diagram of a method of operating vibratory treatment apparatus according to various examples.

The operation of the vibratory treatment apparatus 10, 101, 102 is described in the following paragraphs with reference to FIG. 5.

At block 44, the method includes providing the vibratory treatment apparatus 10, 101, 102. An operator may couple the first receptacle 14 to the second receptacle 20 or to the support 40 and then pour the media 16 into the cavity of the first receptacle 14. The operator may then provide the article 12 to the fixture 22 (or articles to the fixture 38) and manipulate the fixture 22, 38 (by operating one or more clamps of the fixture 22, 38 for example) so that the article 12 is securely held by the fixture 22, 38.

At block 46, the method includes controlling the second actuator 26 to move the first receptacle 14 to vibrate the media 16 relative to the first receptacle 14. In some examples, an operator may turn on one or more motors of the second actuator 26 to move the second receptacle 20 or the support 40, and thus the first receptacle 14, to vibrate the media 16. In other examples, the second actuator 26 may be controlled by a computer running a computer program.

At block 48, the method includes controlling movement of the article 12 relative to the first receptacle 14 and through the first aperture 28 of the first receptacle 14 and thus through the valve 18. The movement of the article 12 may force open the valve 18 and thus cause the valve 18 to change state from the first closed configuration to the second open configuration. In some examples, an operator may manually move the fixture 22, 38. In other examples, the first actuator 24 may be controlled by a computer running a computer program. The fixture 22, 38 may be moved upwards relative to the first receptacle 14 (that is, from the gap between the second receptacle 20 and the first receptacle 14, through the first aperture 28, and then into the cavity of the first receptacle 14). Alternatively, the fixture 22, 38 may be moved downwards relative to the first receptacle 14 (that is, into the cavity defined by the first receptacle 14, through the first aperture 28, and then into the gap between the second receptacle 20 and the first receptacle 14).

As the article 12 is moved into the cavity of the first receptacle 14, the article 12 enters the media 16. The movement of the media 16 within the first receptacle 14 causes the media 16 to impact or rub the article 12 and thus surface treat the article 12. For example, where the media 16 comprises metal spheres for vibratory peening, the metal spheres impact the surface of the article 12 and peen the article 12. By way of another example, where the media 16 comprises ceramic spheres for vibratory polishing, the ceramic spheres rub against the surface of the article 12 and polish the article 12.

The inventors of the present patent application have determined that the effect of peening increases with the increasing depth of the article 12 within the media 16.

As the article 12 is moved upwards or downwards (as indicated by the arrow 30) and through the first aperture 28 of the first receptacle 14, each portion of the article 12 may receive the same cumulative peening effect from the media 16 because each portion may be moved through the whole depth of the media 16 at a constant rate.

At block 48, the article 12 may also be rotated relative to the first receptacle 12 as indicated by arrow 36. For example, where the article 12 is a fan blade of a gas turbine engine, the fixture 34 may be rotated while being moved vertically through the valve 18 (as indicated by arrow 30) so that the twisted structure of the fan blade may move through the first aperture 28. This may provide an additional benefit in that the media 16 may impact the surface of the article 12 perpendicularly and therefore maximise the peening effect of the media 16.

The apparatus 10, 101, 102 may provide several advantages. First, the apparatus 10, 101, 102 may uniformly treat the surface of the article 12. For example, where the media 16 is vibratory peening media, the movement of the article 12 may enable each portion of the article 12 to receive the same cumulative peening effect.

Second, the apparatus 10, 101, 102 may advantageously use less media 16 because the first receptacle 14 has a smaller volume than the second receptacle 20. The reduced amount of media 16 may lower the cost of the apparatus 10, 101, 102. Furthermore, the reduced amount of media 16 may reduce the power consumed by the second actuator 26 in moving the first receptacle 14. This may advantageously reduce the operating cost of the apparatus 10, 101, 102.

Third, the apparatus 101 may advantageously enable multiple articles to receive surface treatment simultaneously and this may reduce the time required to surface treat a batch of articles.

Fourth, the apparatus 10, 101, 102 may advantageously allow surface treatment to be concentrated at a particular portion of the article 12. For example, where it is desired to provide greater surface peening to a particular portion of an article, that portion of the article may be held at the deepest part of the media 16 for longer than the remainder of the article 12.

It will be understood that the invention is not limited to the embodiments above-described and various modifications and improvements can be made without departing from the concepts described herein. For example, the different embodiments may take the form of an entirely hardware embodiment, an entirely software embodiment, or an embodiment containing both hardware and software elements.

Except where mutually exclusive, any of the features may be employed separately or in combination with any other features and the disclosure extends to and includes all combinations and sub-combinations of one or more features described herein.

What is claimed is:

1. Vibratory treatment apparatus comprising:

a first receptacle defining a cavity having an opening arranged to receive vibratory media for vibratory treatment of an article, the first receptacle defining a first aperture opposite the opening of the cavity; and a first valve positioned at the first aperture of the first receptacle, the first valve being arranged to allow passage of the article there through and to prevent the flow of the vibratory media through the first aperture.

2. Vibratory treatment apparatus as claimed in claim 1, further comprising a second receptacle arranged to receive the first receptacle therein, the first receptacle having a first depth and the second receptacle having a second depth, the first depth being less than the second depth.

3. Vibratory treatment apparatus as claimed in claim 2, wherein the first receptacle is coupled to the second receptacle via one or more fasteners.

4. Vibratory treatment apparatus as claimed in claim 2, wherein a width of the first receptacle is less than a width of the second receptacle.

5. Vibratory treatment apparatus as claimed in claim 2, wherein a length of the first receptacle is less than a length of the second receptacle.

6. Vibratory treatment apparatus as claimed in claim 1, further comprising a fixture arranged to support an article for receiving vibratory treatment; and a first actuator arranged to move the fixture relative to the first receptacle.

7. Vibratory treatment apparatus as claimed in claim 6, wherein the fixture is arranged to support a plurality of articles for receiving vibratory treatment.

8. Vibratory treatment apparatus as claimed in claim 1, further comprising a second actuator arranged to move the first receptacle to vibrate the media relative to the first receptacle.

9. Vibratory treatment apparatus as claimed in claim 1, wherein the first receptacle defines a second aperture, and the apparatus further comprises a second valve positioned at the second aperture of the first receptacle, the second valve being arranged to allow passage of another article there through and to prevent flow of the media through the second aperture.

10. Vibratory treatment apparatus as claimed in claim 1, wherein the media is vibratory polishing media.

11. Vibratory treatment apparatus as claimed in claim 1, wherein the media is vibratory peening media.

12. Vibratory treatment apparatus as claimed in claim 1, wherein the article is a fan blade of a gas turbine engine.

13. A method of vibratory treating an article, the method comprising:

providing a vibratory treatment apparatus, the vibratory treatment apparatus comprising:

a first receptacle defining a cavity having an opening arranged to receive vibratory media for vibratory treatment of an article, the first receptacle defining a first aperture opposite the opening of the cavity; and a first valve positioned at the first aperture of the first receptacle, the first valve being arranged to allow passage of the article there through and to prevent the flow of the vibratory media through the first aperture; and controlling movement of the article relative to the first receptacle and through the first aperture of the first receptacle.

14. A method as claimed in claim 13, wherein the method further comprises:

controlling a second actuator to move the first receptacle to vibrate the media relative to the first receptacle.

* * * * *